United States Patent [19]

Weber

[11] 4,163,565

[45] Aug. 7, 1979

[54] SNOW SKI APPARATUS AND METHOD OF MAKING IT

[76] Inventor: Robert C. Weber, Rte. 1, Box 290 BB, Ocean City, Md. 21842

[21] Appl. No.: 819,646

[22] Filed: Jul. 27, 1977

[51] Int. Cl.[2] ..... A63C 17/18; B62B 13/04; B62B 19/04

[52] U.S. Cl. ..... 280/16; 280/7.13; 280/28; 280/87.04 A

[58] Field of Search ..... 280/87.04 A, 87.04 R, 280/7.12, 7.13, 7.14, 600, 601, 607, 608, 609, 12 H, 12 E, 15, 16, 28, 21 R, 21 A

[56] References Cited

U.S. PATENT DOCUMENTS

| | | | |
|---|---|---|---|
| 1,802,116 | 4/1931 | Kinsley | 280/7.13 |
| 3,014,731 | 12/1961 | Dworak | 280/16 |
| 3,203,706 | 8/1965 | Boyden | 280/7.12 |
| 3,900,204 | 8/1975 | Weber | 280/607 |

FOREIGN PATENT DOCUMENTS

| | | | |
|---|---|---|---|
| 898865 | 4/1972 | Canada | 280/15 |
| 2303499 | 8/1974 | Fed. Rep. of Germany | 280/609 |
| 408734 | 9/1966 | Switzerland | 280/609 |

*Primary Examiner*—David M. Mitchell

*Attorney, Agent, or Firm*—Beveridge, DeGrandi, Kline & Lunsford

[57] ABSTRACT

A snow ski apparatus has an occupant-supporting board, a forward runner with a running surface wider in its forward portion than its rear portion and a rear runner with a running surface narrower in its forward portion than in its rear portion. An axle pivotally connected to the board extends through flanges which lie longitudinally along the sides of the runners. Elastic tension means are connected to the runners to bias the runners toward longitudinal alignment with the board.

A runner has an undersurface which intersects an inclined surface at an acute angle to form a biting edge to reduce lateral slippage when making a turn.

The runners are molded with upstanding side flanges, and portions of such flanges are removed to modify the flex characteristics of the runner body.

7 Claims, 9 Drawing Figures

FIG.1
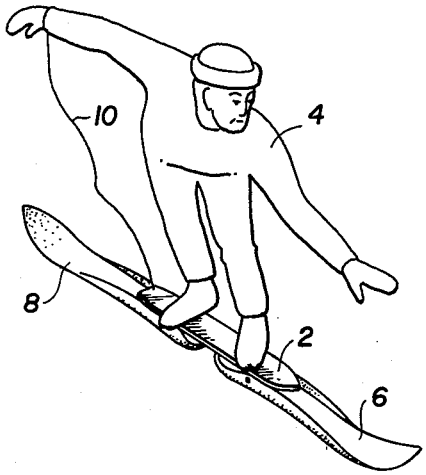
FIG.6
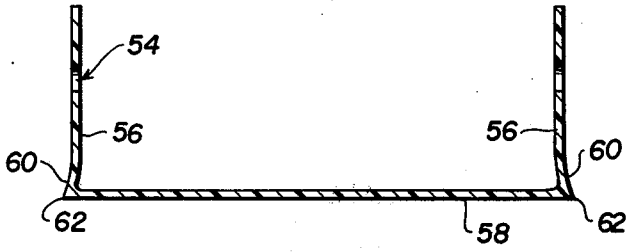
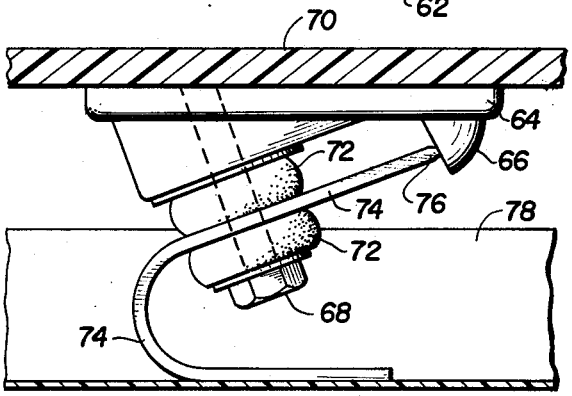
FIG.7
FIG.8
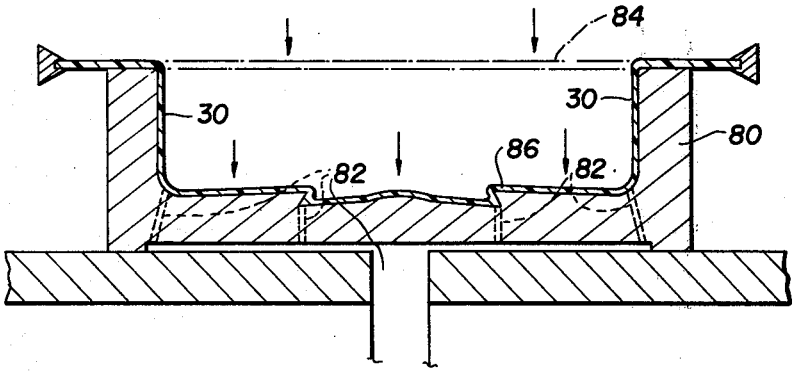
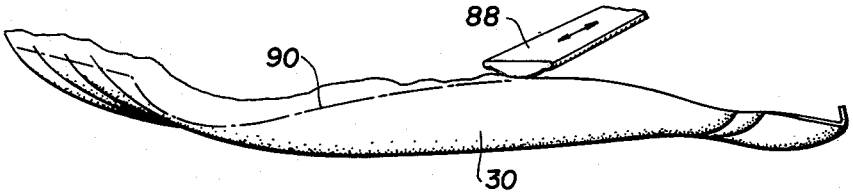
FIG.9

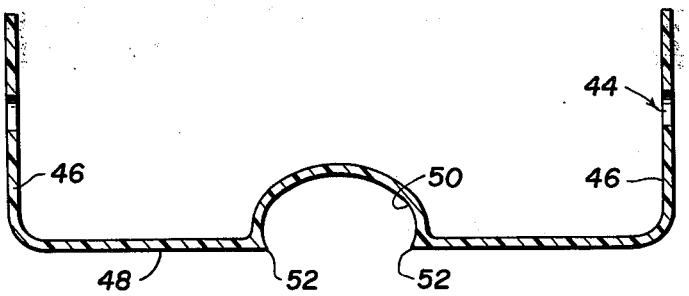
FIG.5
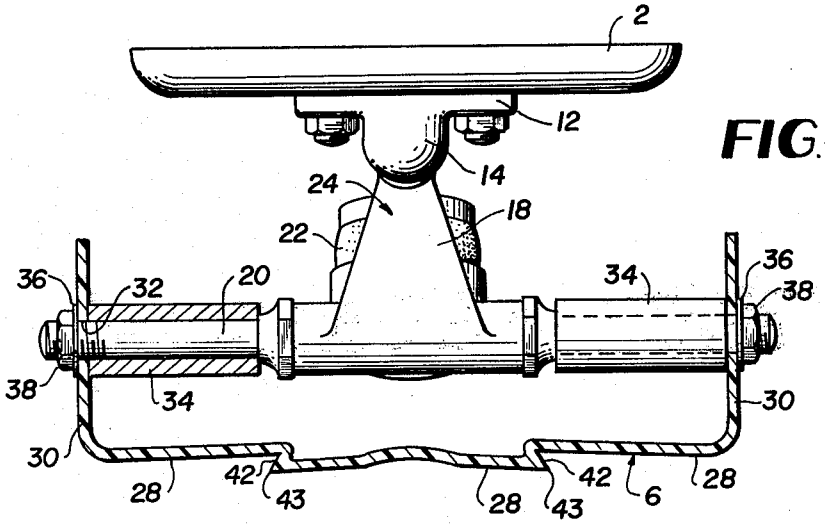
FIG.4
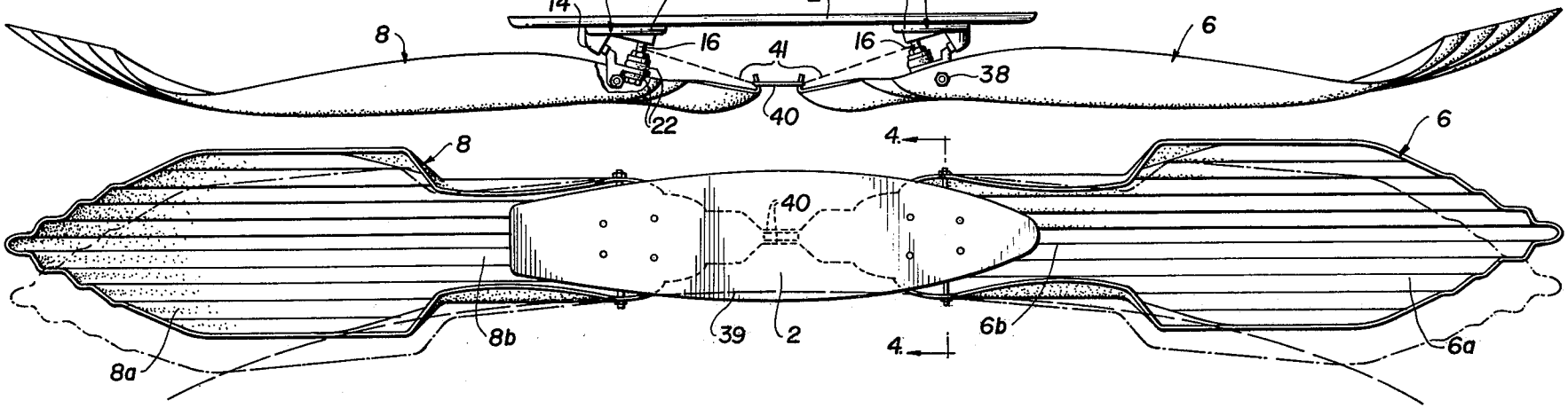
FIG.2
FIG.3

SNOW SKI APPARATUS AND METHOD OF MAKING IT

BACKGROUND AND SUMMARY OF THE INVENTION

This invention relates to snow ski apparatus, a runner for snow skis and a method of making runners for snow skis.

It is known to provide snow conveyances with two longitudinally aligned runners, such construction being typified by U.S. Pat. No. 2,316,272 and U.S. Pat. No. 3,717,359, the latter of which discloses a tensioned elastic member attached to the forward runner for returning it to its central position. Ordinary skateboards have a board with forward and rear trucks which cause the wheel-carrying axles to turn in opposite directions in response to inclination of the board. Conventional recreational skis are sidecut to assist in turning, the central portion thereof being narrower than the forward and rear portions.

According to one inventive aspect disclosed in this specification a snow ski apparatus includes an occupant-supporting board, and forward and rear runners connected to the board, the forward runner being wider at its forward portion than at its rear portion and the rear runner being wider at its rear portion than at its forward portion. This enables the runners together to provide an inwardly curved edge to facilitate turning when the board and the runners are tilted sideways.

Another aspect of the invention involves a snow ski apparatus including a board having an upper surface for supporting an occupant, forward and rear runners which turn in response to lateral tilting of the board, and elastic tension means connected to the rear runner and to the forward runner to bias the runners toward longitudinal alignment with the board, whereby the stress of the elastic means governs the resistance to turning movement of the runners relative to the board.

Another aspect of the invention involves a structure connecting an occupant-supporting board to at least one runner therebeneath, the runner being provided with apertured upstanding flanges, and the connector means having an axle with its opposite ends extending through the flanges for retention thereon.

The invention also pertains to a runner capable of use singly or in combination with other runners on a snow conveyance. Specifically, the runner is provided with an undersurface for contacting the body of snow during movement thereover, an inclined surface extending longitudinally of the runner and intersecting the undersurface at an acute angle to form a biting edge to reduce lateral slippage when making a turn.

The manufacturing technique disclosed herein, usable for making a wide variety of runners for various purposes, includes the steps of molding a runner body to provide upstanding flanges which extend longitudinally along its opposite sides; and, planing, shaving or otherwise removing portions of the flanges to modify the flex characteristics of the runner body to provide a flexibility suited to the intended use of the runner.

Any of the inventive features summarized hereinabove may be used in a wide variety of situations, a preferred and desirable combination of all of these features being incorporated in the preferred structure and method disclosed below.

BRIEF DESCRIPTION OF THE DRAWINGS

FIG. 1 is a perspective view of a preferred embodiment of the invention in use by a standing occupant.

FIG. 2 is a side elevational view of the preferred embodiment of the invention.

FIG. 3 is a plan view of the embodiment of FIGS. 1 and 2, showing in dot-dash lines one of the turning positions of the runners.

FIG. 4 is a transverse sectional view of the embodiment of FIGS. 1–3 showing a means for connecting the runners to the board.

FIGS. 5 and 6 are transverse sectional views of alternate runner configurations.

FIG. 7 is a side elevational view of an alternate structure for connecting the occupant-supporting board to the runners.

FIGS. 8 and 9 illustrate a preferred method of forming runners, a molding step being shown in FIG. 8 and a flex-modifying flange-shaping step being shown in FIG. 9.

BRIEF DESCRIPTION OF THE PREFERRED EMBODIMENTS

In FIG. 1 it will be seen that the preferred embodiment of the invention involves a platform or board 2 provided with an upper surface for supporting a standing occupant 4. A forward runner 6 and a rear runner 8 are connected to the board 2 so that the runners 6 and 8 will turn in opposite directions relative to the board in response to lateral tilting of the board, as in a conventional skateboard. As a safety precaution to prevent runaway of the device if the occupant falls, there is a safety strap 10 connected at its opposite ends to the wrist of the occupant and to the board 2. Alternatively, the safety strap may be connected between any portion of the occupant and any portion of the apparatus.

When the occupant 4 shifts his weight to tilt the board 2 to the left, the runners 6 and 8 will turn relative to the board, displacing the forward tip of runner 6 and the rear tip of runner 8 to the left side of the board 12. This will cause the apparatus to turn to the left. Inclination of the board to the right causes the forward tip of runner 6 and the rear tip of runner 8 to move to the right, causing a turning movement to the right. This position of the runners is shown in the dot-dash lines of FIG. 3.

A preferred means for connecting the board 2 to the runners 6 and 8 is a conventional skateboard truck, a representative truck of this nature being shown in FIGS. 2 and 4. Each truck includes a base plate 12 and a pivoted axle assembly 18. The plate 12 has a depending boss 14 at one end and a depending inclined bolt 16 at its other end. The axle assembly 18, including transverse axle 20, is pivotally supported about an inclined pivot axis, the axle assembly 18 being pivoted at one end in a recess in the boss 14 and supported at its other end between a pair of cushions 22 on the bolt 16. In this specification, the forward truck is designated 24 and the rear truck is designated 26.

The attachment of the forward truck 24 to the forward runner 6 is illustrated in FIG. 4. Here, it will be seen that the forward runner 6 is of generally U-shaped transverse cross section having an undersurface 28 for riding on a body of snow and integral upstanding flanges 30 which extend longitudinally along opposite sides of the runner. The upstanding flanges 30 are provided with apertures 32 which receive the axle 20 of the truck. Bushings 34 are located interiorly of the flanges 30; and, washers 36 and nuts 38 are located exteriorly of the flanges so that the tightened nuts 38 securely hold the axle 20 of the truck 24 on the runner flanges 30. The truck 24 thus serves as a connector which attaches the runner to the board, enabling the runner to pivot about an axis which is inclined relative to the board 2 and extends upwardly from left to right as viewed in FIG. 2. FIG. 2 also shows the rear truck 26 connecting rear runner 8 to the board 2. The pivot axis of rear truck 26 lies in the opposite direction, extending downwardly from left to right. The pivotal axes of the respective trucks 24 and 26 intersect each other at a point beneath the board 2.

The ability of the apparatus to turn is enhanced by giving the runners the general configuration shown in FIG. 3 where it will be seen that the forward runner 6 has a forward portion 6*a* which is wider than its rear portion 6*b*; and, the rear runner 8 has its rear portion 8*a* wider than its forward portion 8*b*. With this construction, the runners 6 and 8 together provide an inwardly curved edge approximated by the line 39 in FIG. 3. This acts similarly to the sidecut in conventional skis, assisting initiation of a turn. It also supplements the runner-turning action of the trucks 24 and 26 as described above.

Another preferred feature of the apparatus is an elastic tensioning means which biases the runners 6 and 8 to their central positions, longitudinally aligned with the board 2. This tensioning means may be a tensioned elastic strap 40 connected between the rear end of the forward runner 6 and the forward end of the rear runner 8. Alternatively, the elastic tensioning means may extend from truck-to-truck as shown by the lines 41, passing slidably through openings in the rear of runner 6 and the front of runner 8 to occupy also the area shown at 40. Likewise, two separate elastic members may be used, one extending between the forward truck 24 and the forward end of rear runner 8, and the other extending between the rear truck 26 and the rear end of the forward runner 6. In any of these cases, the elastic tensioning means will bias the runners toward their longitudinally aligned positions. The members 40 may easily be retied, adjusting their tension to govern the resistance to turning movement of the runners relative to the board.

Another desirable feature of the disclosed apparatus is the provision of biting edges located on the undersurface of the runners 6 and 8 to reduce lateral slippage when making a turn. Although these biting edges may be provided in many ways, three preferred constructions are illustrated in FIGS. 4, 5 and 6. In connection with FIG. 4, it was previously pointed out that the runner is provided with an undersurface 28 for contacting the body of snow. There is also a pair of surfaces 42 which are inclined in opposite directions and extend longitudinally of the runner. These surfaces 42 intersect the undersurface 28 at oppositely-directed acute angles to form the biting edges 43. Both biting edges 43 are spaced inwardly from the longitudinal edges of the runner 6.

In the configuration shown in FIG. 5, the runner 44 is provided with upstanding flanges 46 and a bottom wall which has an undersurface 48. The arcuate surface 50 forms the inclined surface which intersects the undersurface 48 to provide the oppositely-facing acute angle biting edges 52 spaced inwardly from the longitudinal edges of the runner 44.

The runner 54 of FIG. 6 also is provided with upstanding side flanges 56 and a bottom wall providing the undersurface 58. In this embodiment, the inclined surfaces 60 intersect the undersurface 58 to form oppositely-facing acute angle biting edges 62 which are located at the longitudinal edges of the runner.

Rather than using regular skateboard trucks, it is possible to use less complicated devices for connecting the runners to the board. One such device is illustrated in FIG. 7 which shows a base plate 64 with a depending boss 66 at its forward end and an inclined bolt 68 at its rear end. The base plate 64 is affixed to the board 70 which corresponds to the board 2 in FIG. 1. The bolt 68 supports a pair of cushions 72 of the same kind used in conventional skateboards. Sandwiched between the cushions 72 is a tiltable member 74 which has a forward projecting end 76 pivotally received in an inclined recess in boss 66. The amount of pivotal movement permitted is limited by the extent to which the cushions 72 are compressed. The tiltable member 74, preferably formed of fiberglass reinforced resin, extends rearwardly and then bends forwardly to a horizontal segment which is bonded directly to the runner 78.

One advantage of the particular runners used in the preferred embodiment of the invention is that they are easily and inexpensively made, and may be fine-tuned to provide them with the desired flex characteristics. They may be thermoformed of stock sheet material, and the upstanding flanges produced by the thermoforming process may be reshaped in order to provide the desired flexibility.

FIG. 8 shows a female mold 80 with vacuum passages 82 which initially supports a heated sheet of plastic at the position shown at 84. The passages 82 are then evacuated to draw the sheet 84 to the configuration shown at 86. The partially-formed runner may then be removed from the mold 80. Although the mold 80 is shown as a female mold, it is possible to provide instead a male thermoforming mold or conventional mold halves when the runner is to be made by injection molding. However, thermoforming in a female mold is preferred as it offers a relatively inexpensive method which provides good definition of the biting edges 43, 52 and 62.

After being removed from the mold and cooling, portions of the upstanding flanges 30 of the runner are removed by a shaping device 88 as shown in FIG. 9, such shaping device preferably being a model 21-115 Surform shaver with a blade 21-515, made and sold by Stanley Works, New Britain, Connecticut. The step illustrated in FIG. 9 is quite desirable as it enables the craftsman or user to modify the flex characteristics of the runner body thereby providing a longitudinally-varying flexibility suited to the intended use of the runner. For example, when central stiffness and forward and rear flexibility are desired, the flange 30 is removed to the position shown by dash-dot line 90 in FIG. 9. If uniform flexibility were desired along the length of the runner, the height of the flange 30 should be substantially uniform along its length. The areas to have the greater flexibility will, of course, be shaped to provide them with the lesser flange height.

In this specification, only preferred representative embodiments of the various aspects of the invention have been shown. Persons skilled in the art will realize that various features hereof may be used in quite diverse structures and are susceptible to modification and improvement. Therefore, it is emphasized that the invention is not limited only to the subject matter disclosed hereinabove, but is meant to include a wide variety of other structures and methods within the spirit af the claims which follow.

I claim:

1. Snow ski apparatus comprising, a board having an upper surface for supporting the feet of a standing occupant, a forward runner and a rear runner which together provide an undersurface for contacting the snow when the apparatus is in use, first connector means connecting the forward runner to said board, second connector means connecting the rear runner to said board, said forward runner being longitudinally symmetrical and having an undersurface with a forward portion and a rear portion, said forward portion being wider than said rear portion, said rear runner being longitudinally symmetrical and longitudinally aligned with said front runner, said rear runner having an undersurface with a forward portion and a rear portion, said undersurface of the rear runner being wider at its rear portion than at its forward portion, said runners together providing an inwardly curved edge to facilitate turning when said board and said runners are tilted sideways.

2. The snow ski apparatus of claim 1 wherein at least one of the runners is provided with an inclined surface extending longitudinally of said runner and intersecting its respective said undersurface at an acute angle to form a biting edge to reduce lateral slippage when making a turn.

3. The snow ski apparatus of claim 1 wherein at least one of said runners is formed of a sheet of material of substantially uniform thickness and has integral upstanding flanges extending longitudinally along its opposite sides.

4. The snow ski apparatus of claim 3 wherein each of said connector means includes an axle pivotally supported on said board for movement about a pivot axis inclined with respect to said board, said axis lying substantially in the central vertical longitudinal plane of said board, said flanges in each of said runners having apertures receiving said axles, and means for retaining said axles on said flanges.

5. The snow ski apparatus of claim 1 wherein the first connector means includes means for supporting the forward runner for pivotal movement about a first pivot axis inclined with respect to said board, and the second connector means includes means for supporting the rear runner for pivotal movement about a second pivot axis inclined with respect to said board, said pivot axes lying substantially in the central vertical longitudinal plane of said board and intersecting beneath said board.

6. The snow ski apparatus of claim 5 wherein at least one of said runners is formed of a sheet of material of substantially uniform thickness and has integral upstanding flanges extending longitudinally along it opposite sides.

7. The snow ski apparatus of claim 5 wherein at least one of the runners is provided with an inclined surface extending longitudinally of said runner and intersecting its respective said undersurface at an acute angle to form a biting edge to reduce lateral slippage when making a turn.

* * * * *